US009087650B2

(12) United States Patent
Ma et al.

(10) Patent No.: US 9,087,650 B2
(45) Date of Patent: Jul. 21, 2015

(54) KEYCAP STRUCTURE

(71) Applicant: Primax Electronics Ltd., Neihu, Taipei (TW)

(72) Inventors: Hui Ma, Taipei (TW); Chuang-Shu Jhuang, Taipei (TW); De-Guang Zhu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 177 days.

(21) Appl. No.: 13/867,930

(22) Filed: Apr. 22, 2013

(65) Prior Publication Data

US 2014/0216905 A1 Aug. 7, 2014

(30) Foreign Application Priority Data

Feb. 1, 2013 (CN) ..... 2013 1 0040945

(51) Int. Cl.
*H01H 13/70* (2006.01)
*H01H 3/12* (2006.01)

(52) U.S. Cl.
CPC ..... *H01H 3/122* (2013.01); *H01H 3/125* (2013.01); *H01H 13/70* (2013.01)

(58) Field of Classification Search
CPC ..... H01H 3/00; H01H 3/02; H01H 3/12; H01H 9/02; H01H 13/00; H01H 13/70; H01H 13/702; H01H 13/84; H01H 13/85; H01H 13/86; H01H 2003/00; H01H 2003/02; H01H 2003/12; H01H 2009/02; H01H 2201/00; H01H 2205/00; H01H 2205/004; H01H 2221/00; H01H 2223/00; H01H 2223/03; H01H 2231/002; H01H 2233/00; H01H 2233/002; H01H 2233/03; H01H 2233/07; H01H 2237/00; H01H 2237/004; H01H 2239/006; H01H 2239/076
USPC ..... 200/343, 345, 318, 318.1, 329, 332, 200/333, 335, 337, 341, 344
See application file for complete search history.

(56) References Cited

U.S. PATENT DOCUMENTS 6,020,566 A * 2/2000 Tsai ..... 200/344
8,188,387 B2 * 5/2012 Lo et al. ..... 200/5 A

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

A keycap structure includes a reinforcement element and a keycap body. The reinforcement element includes two long segments and two short segments. The keycap body includes plural fixing parts and two protruding parts. The plural fixing parts are used for fixing two ends of each long segment of the reinforcement element. The two protruding parts are used for pushing the two short segments of the reinforcement element, so that the reinforcement element is subjected to deformation. Consequently, the reinforcement element generates a reacting force to push against the bilateral sides of the keycap body. Under this circumstance, the top surface of the keycap body is formed as a downwardly-concave arc-shaped surface, so that the shape of the keycap structure is effectively corrected.

8 Claims, 4 Drawing Sheets

KEYCAP STRUCTURE

FIELD OF THE INVENTION

The present invention relates to a keycap structure, and more particularly to a keycap structure of a keyboard.

BACKGROUND OF THE INVENTION

For facilitating users to operate electronic devices, a variety of human interface devices are gradually introduced into the market. For example, a keyboard is a widely-used human interface device for controlling a computer. Generally, the keyboard is equipped with plural character keys and plural function keys for generating different signals. According to these signals, corresponding functions of the electronic device can be operated by the user. By depressing one of the character keys, a corresponding letter, number or symbol is inputted. By depressing one of the function keys, a corresponding function signal is generated. Moreover, the function key and a corresponding character key may be combined as a shortcut.

For providing better tactile feel of depressing the keycap of the key, the top surface of the keycap is specially designed to have a downwardly-concave arc-shaped surface for complying with the curvature of the user's fingertip. Moreover, some of the character keys and some of the plural function keys have elongated keycaps. For example, the key "0" of the numeric keypad zone, the enter key or the space key has the elongated keycap.

Since most keycaps are produced by a plastic ejection molding process, the elongated keycaps made of the plastic material may have some drawbacks. For example, since the elongated keycap has a relative long pressing surface, the structural strength of the elongated keycap is usually lower than the structural strength of the ordinary keycap. After the elongated keycap has been pressed for a long time, the elongated keycap is readily damaged. Moreover, since the plastic product is possibly suffered from deformation, the top surface of the elongated keycap may be changed from the downwardly-concave arc-shaped surface to an upwardly-convex arc-shaped surface. Under this circumstance, since the tactile feel of depressing the elongated keycap is deteriorated and the membrane switch under the elongated keycap is difficult to be conducted, the sensitivity of the key is impaired.

For overcoming the above drawbacks, there is a need of providing an improved keycap structure in order to enhance the structural strength of the elongated keycap and correct the deformed top surface of the elongated keycap from the upwardly-convex arc-shaped surface to the downwardly-concave arc-shaped surface.

SUMMARY OF THE INVENTION

The present invention provides a keycap structure capable of correcting the deformation.

In accordance with an aspect of the present invention, there is provided a keycap structure. The keycap structure includes a reinforcement element and a keycap body. The reinforcement element includes two long segments and two short segments. The keycap body is connected with the reinforcement element. The keycap body includes plural fixing parts and two protruding parts. The plural fixing parts are disposed on a bottom surface of the keycap body for fixing two ends of each long segment of the reinforcement element. The two protruding parts are disposed on the bottom surface of the keycap body for pushing the two short segments of the reinforcement element. Consequently, a distance between each short segment of the reinforcement element and a top surface of the keycap body is larger than a distance between each long segment of the reinforcement element and the top surface of the keycap body.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
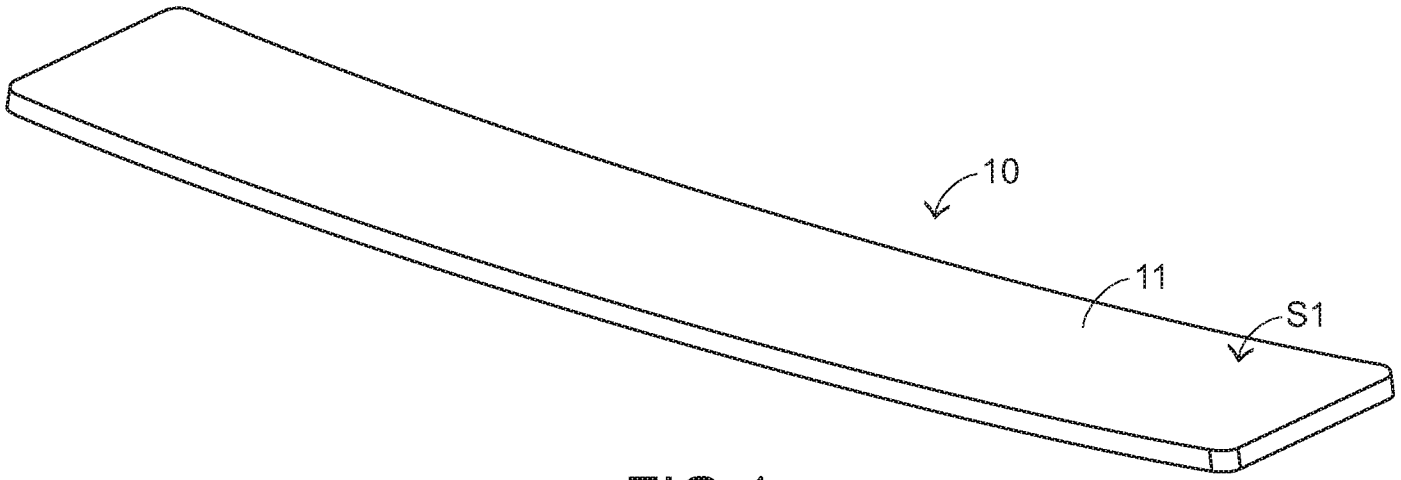
FIG. 1 is a schematic perspective view illustrating a keycap structure according to an embodiment of the present invention.
Figure 2:
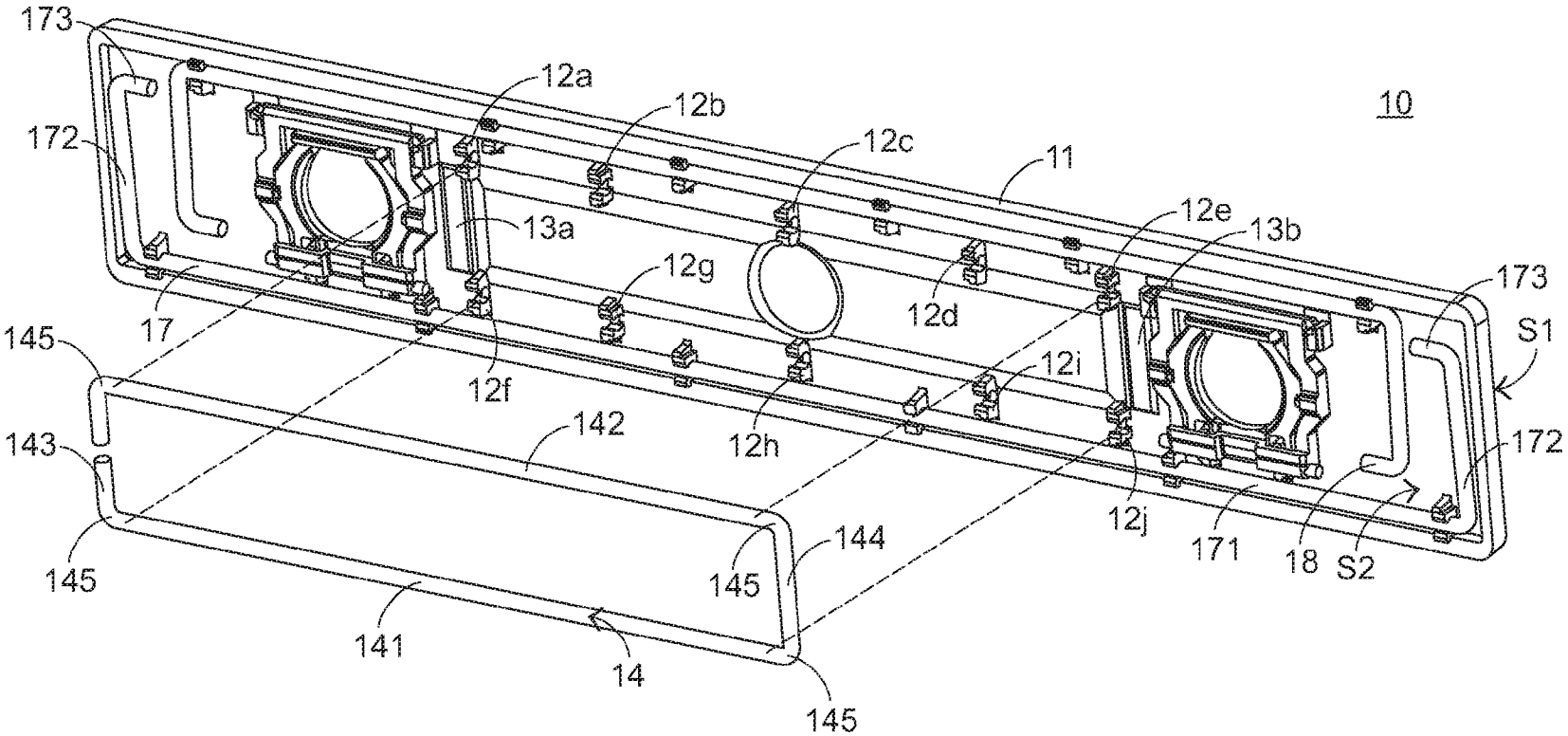
FIG. 2 is a schematic exploded view illustrating the keycap structure of FIG. 1 and taken along another viewpoint.

Please refer to FIGS. 1 and 2. FIG. 1 is a schematic perspective view illustrating a keycap structure according to an embodiment of the present invention. FIG. 2 is a schematic exploded view illustrating the keycap structure of FIG. 1 and taken along another viewpoint. As shown in FIGS. 1 and 2, the keycap structure 10 comprises a keycap body 11, a reinforcement element 14, a first stabilizer bar 17, and a second stabilizer bar 18. The keycap body 11 comprises a top surface S1, a bottom surface S2, plural fixing parts 12*a*, 12*b*, 12*c*, 12*d*, 12*e*, 12*f*, 12*g*, 12*h*, 12*i* and 12*j*, and two protruding parts 13*a* and 13*b*.

The top surface S1 and the bottom surface S2 of the keycap body 11 are opposed to each other. The top surface S1 of the keycap body 11 may be touched and pressed by the user's finger. The bottom surface S2 of the keycap body 11 faces a base plate (not shown) of a keyboard. The reinforcement element 14, the first stabilizer bar 17 and the second stabilizer bar 18 are connected with the bottom surface S2 of the keycap body 11.

The plural fixing parts 12*a*-12*j* and the protruding parts 13*a* and 13*b* are all disposed on the bottom surface S2 of the keycap body 11. The plural fixing parts 12*a*-12*j* are used for fixing the reinforcement element 14. The protruding parts 13*a* and 13*b* are used for pushing the reinforcement element 14. In this embodiment, the keycap body 11, the plural fixing parts 12*a*-12*j* and the protruding parts 13*a* and 13*b* are integrally formed with each other. Moreover, the plural fixing parts 12*a*-12*j* are fixing recesses, but are not limited thereto.

The reinforcement element 14 comprises two long segments 141, 142, two short segments 143, 144, and plural bent parts 145. The plural bent parts 145 are arranged between the long segments 141, 142 and the short segments 143, 144. These bent parts 145 are connected with the long segments 141, 142 and their adjacent short segments 143, 144. Consequently, the reinforcement element 14 is substantially a ring-shaped rod. In this embodiment, the reinforcement element 14 is a ring-shaped rod made of a material with high structural strength (e.g. a metallic material).

Since the keycap body 11 is made of a plastic material, the structural strength of the reinforcement element 14 is higher than the structural strength of the keycap body 11. Moreover, since the reinforcement element 14 is disposed on the bottom surface S2 of the keycap body 11, the reinforcement element 14 has the function of supporting the keycap body 11 and dispersing the force which is exerted on the keycap body 11. Consequently, the use of the reinforcement element 14 can increase the structural strength of the keycap structure 10 and prolong the use of the keycap body 11. Moreover, the use of the reinforcement element 14 can correct the deformation of the keycap body 11. The way of correcting the deformation of the keycap body 11 by the reinforcement element 14 will be illustrated in more details as follows.

In this embodiment, the two long segments 141 and 142 of the reinforcement element 14 are parallel with each other, and the two short segments 143 and 144 of the reinforcement element 14 are parallel with each other. Moreover, the reinforcement element 14 is a non-closed and rectangular ring-shaped rod made of a metallic material, but is not limited thereto.

The structures and the installing purposes of the first stabilizer bar 17 and the second stabilizer bar 18 will be illustrated as follows. The first stabilizer bar 17 comprises a main bar part 171, two lateral bar parts 172, and two end bar parts 173. The main bar part 171 of the first stabilizer bar 17 is longer than each of the lateral bar parts 172. The two lateral bar parts 172 are located at two ends of the main bar part 171, respectively. Moreover, a bent part is formed between the main bar part 171 and a first end of the corresponding lateral bar part 172. The two end bar parts 173 are connected to second ends of the lateral bar parts 172, respectively. Moreover, another bent part is formed between each end bar part 173 and the second end of the corresponding lateral bar part 172.

The main bar part 171 of the first stabilizer bar 17 is fixed on the bottom surface S2 of the keycap body 11. Moreover, the main bar part 171 is parallel with the long sides of the keycap body 11 for supporting the keycap body 11. The two end bar parts 173 of the first stabilizer bar 17 is disposed on the base plate (not shown) of the keyboard for fixing the keycap body 11. The structure of the second stabilizer bar 18 is substantially identical to the first stabilizer bar 17. Moreover, the second stabilizer bar 18 is also parallel with the long sides of the keycap body 11. However, a vacant space of the second stabilizer bar 18 and a vacant space of the first stabilizer bar 17 are oriented in opposite directions.

When the keycap body 11 is depressed to be descended, the first stabilizer bar 17 and the second stabilizer bar 18 can maintain the balance of the keycap body 11. Consequently, the descending distances of the four corners of the keycap body 11 are equal. As known, if the descending distances of the four corners of the keycap body 11 are not equal, the keycap body 11 is tilted, and thus the tactile feel of depressing the keycap body 11 is unsatisfied. Since the descending distances of the four corners of the keycap body 11 are equal by using the keycap structure 10 of the present invention, the tactile feel is enhanced.

Figure 3:
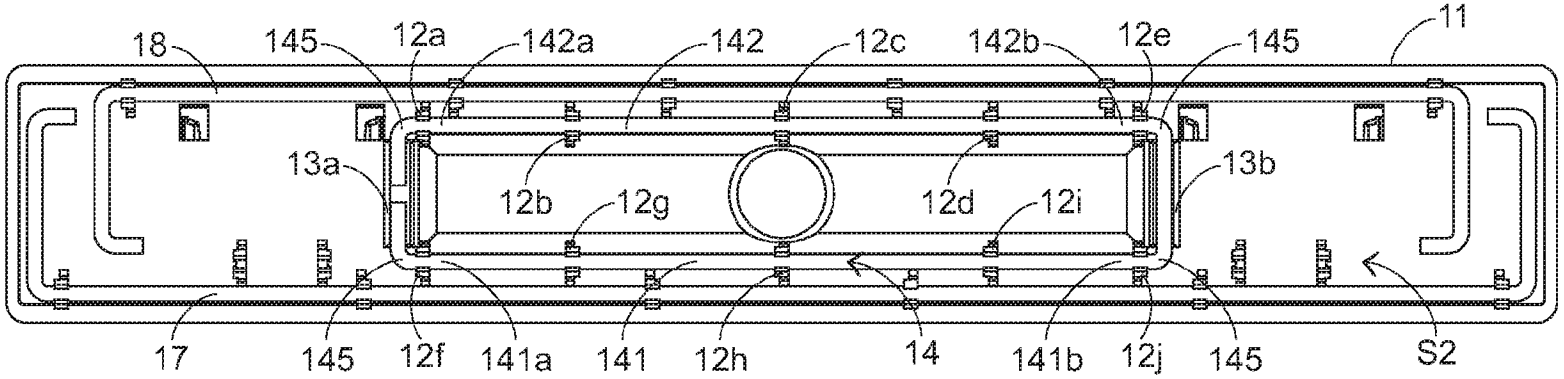
FIG. 3 is a schematic bottom view illustrating the keycap structure according to the embodiment of the present invention.

FIG. 3 is a schematic bottom view illustrating the keycap structure according to the embodiment of the present invention. Please refer to FIGS. 2 and 3. The plural fixing parts 12*a*-12*j* are disposed on the bottom surface S2 of the keycap body 11 for connecting the two long segments 141 and 142 of the reinforcement element 14. Consequently, the reinforcement element 14 can be fixed on the bottom surface S2 of the keycap body 11 through the plural fixing parts 12*a*-12*j*. In this embodiment, the fixing parts 12*a* and 12*e* are connected with the two ends 142*a* and 142*b* of the long segment 142 of the reinforcement element 14, and located near the corresponding bent parts 145 of the reinforcement element 14. Moreover, the fixing parts 12*f* and 12*j* are respectively connected with the two ends 141*a* and 141*b* of the long segment 141 of the reinforcement element 14, and located near the bent parts 145 of the reinforcement element 14.

The protruding parts 13*a* and 13*b* are disposed on the bottom surface S2 of the keycap body 11 for pushing the two short segments 143 and 144 of the reinforcement element 14. As shown in FIG. 2, the protruding parts 13*a* and 13*b* are disposed over the two short segments 143 and 144 of the reinforcement element 14, respectively. In this embodiment, the protruding part 13*a* is parallel with the protruding part 13*b*. Moreover, the two protruding parts 13*a* and 13*b* are parallel with the two short segments 143 and 144 of the reinforcement element 14, respectively. As shown in FIG. 2, after the reinforcement element 14 is connected with the plural fixing parts 12*a*~12*j*, the two short segments 143 and 144 of the reinforcement element 14 are respectively pushed by the two protruding parts 13*a* and 13*b* in order to provide acting forces to the two short segments 143 and 144 of the reinforcement element 14.

Figure 4:
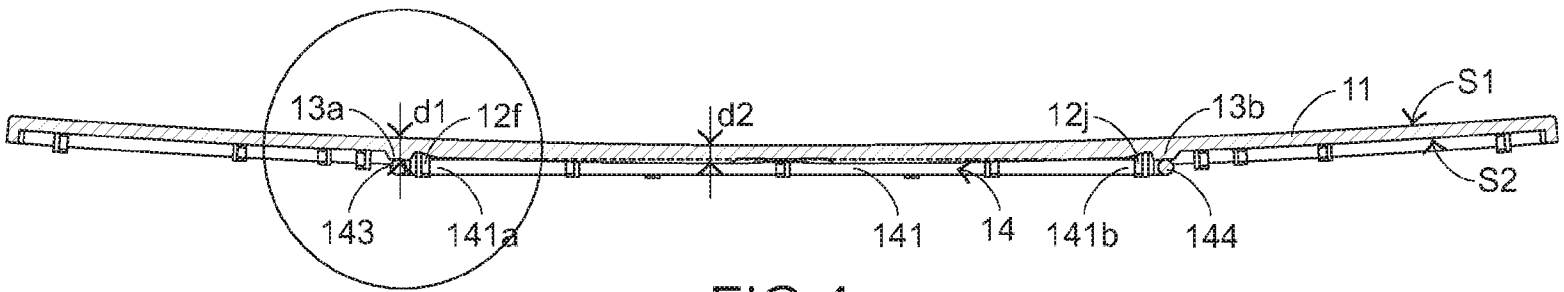
FIG. 4 is a schematic cross-sectional view illustrating the keycap structure according to the embodiment of the present invention.
Figure 5:
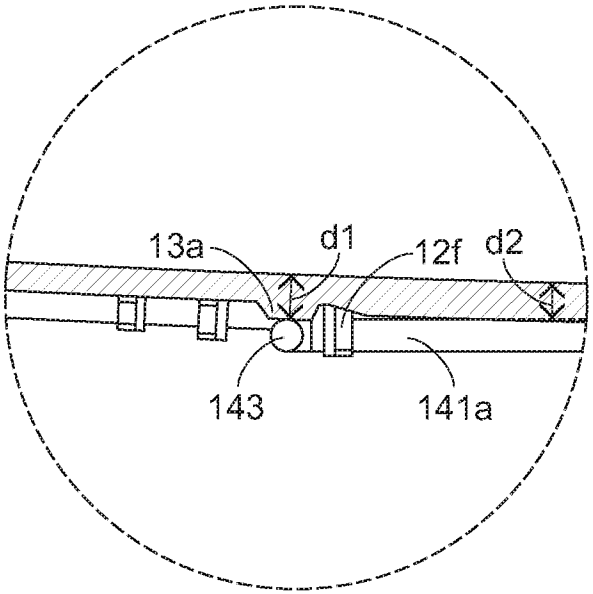
FIG. 5 is a schematic enlarged fragmentary view illustrating the keycap structure of FIG. 4.

Please refer to FIGS. 4 and 5. FIG. 4 is a schematic cross-sectional view illustrating the keycap structure according to the embodiment of the present invention. FIG. 5 is a schematic enlarged fragmentary view illustrating the keycap structure of FIG. 4. As shown in FIGS. 4 and 5, the end 141*a* of the long segment 141 of the reinforcement element 14 is fixed on the fixing part 12*f* of the bottom surface S2 of the keycap body 11, and the end 141*b* of the long segment 141 of the reinforcement element 14 is fixed on the fixing part 12*j* of the bottom surface S2 of the keycap body 11.

Since the distance d1 between the top side of the short segment 143 of the reinforcement element 14 and the top surface S1 of the keycap body 11 is larger than the distance d2 between the long segment 141 of the reinforcement element 14 and the top surface S1 of the keycap body 11, the short segment 143 of the reinforcement element 14 is pushed by the protruding part 13*a* of the bottom surface S2 of the keycap body 11 and the short segment 144 of the reinforcement element 14 is pushed by the protruding part 13*b*. In other words, by using the two ends 141*a* and 141*b* of the long segment 141 of the reinforcement element 14 as fulcrums, the two protruding parts 13*a* and 13*b* push downwardly against the short segments 143 and 144 of the reinforcement element 14 and exert acting forces on the short segments 143 and 144 of the reinforcement element 14.

When the reinforcement element 14 is pushed by the protruding parts 13*a* and 13*b*, in response to the acting forces, the reinforcement element 14 generates a reacting force to push upwardly against the protruding parts 13*a* and 13*b* of the keycap body 11. In response to the reacting force, the bilateral sides of the keycap body 11 are bent upwardly, so that the top surface S1 of the keycap body 11 is formed as the downwardly-concave arc-shaped surface. Under this circumstance, the tactile feel of depressing the keycap structure 10 to the user is enhanced, and the sensitivity of the keycap structure 10 of the corresponding key is increased.

From the above description, the present invention provides a keycap structure. The keycap structure comprises a keycap body and a reinforcement element. The keycap body comprises plural fixing parts and two protruding parts. The reinforcement element comprises two long segments and two short segments. The plural fixing parts are used for fixing two ends of each long segment of the reinforcement element. The two protruding parts are used for pushing the two short segments of the reinforcement element and exert acting forces on the short segments of the reinforcement element. In response to the acting forces, the reinforcement element generates a reacting force to push upwardly against the keycap body. In response to the reacting force, the top surface of the keycap body is formed as the downwardly-concave arc-shaped surface. The reinforcement element is capable of enhancing the structural strength of the keycap structure and correcting the deformed keycap structure to the downwardly-concave arc-shaped surface. Under this circumstance, the tactile feel of depressing the keycap structure to the user is enhanced, and the sensitivity of the keycap structure of the corresponding key is increased.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A keycap structure, comprising:

a reinforcement element comprising two long segments and two short segments; and a keycap body connected with said reinforcement element, and comprising:

plural fixing parts disposed on a bottom surface of said keycap body for fixing thereto two ends of each long segment of said reinforcement element; and two protruding parts protruding downward from said bottom surface of said keycap body and aligned with said two short segments, respectively;

wherein when said keycap body is pushed down, said two protruding parts urge against said two short segments of said reinforcement element, respectively, so that a top surface of said keycap body forms a downwardly-concave arc-shaped surface with a distance between each short segment of said reinforcement element and said top surface of said keycap body being larger than a distance between each long segment of said reinforcement element and said top surface of said keycap body.

2. The keycap structure according to claim 1, wherein said two long segments are disposed opposite to each other, two short segments are disposed opposite to each other and connecting to said long segments with two ends thereof, and said reinforcement element lies under said keycap body with said two long segments and said two short segments being substantially at the same level.

3. The keycap structure according to claim 1, wherein said reinforcement element is a ring-shaped rod made of a metallic material.

4. The keycap structure according to claim 1, wherein said reinforcement element is a rectangular ring-shaped rod.

5. The keycap structure according to claim 1, wherein said plural fixing parts are fixing recesses.

6. The keycap structure according to claim 1, wherein said keycap body, said plural fixing parts and said two protruding parts are integrally formed with each other.

7. The keycap structure according to claim 1, wherein said keycap structure further comprises a stabilizer bar, and said stabilizer bar is disposed on said bottom surface of said keycap body.

8. The keycap structure according to claim 7, wherein said stabilizer bar is a metal bar.

* * * * *